US012532928B1

(12) United States Patent
Rankine et al.

(10) Patent No.: US 12,532,928 B1
(45) Date of Patent: Jan. 27, 2026

(54) GARMENT WITH ADJUSTABLE COLLAR

(71) Applicant: Acushnet Company, Fairhaven, MA (US)

(72) Inventors: Brock D. Rankine, New Bedford, MA (US); Peter J. Skurla, III, Bridgewater, MA (US)

(73) Assignee: Acushnet Company, Fairhaven, MA (US)

( * ) Notice: Subject to any disclaimer, the term of this patent is extended or adjusted under 35 U.S.C. 154(b) by 0 days.

(21) Appl. No.: 18/952,464

(22) Filed: Nov. 19, 2024

(51) Int. Cl.
*A41D 27/00* (2006.01)
*A41D 1/02* (2006.01)
*A41D 27/18* (2006.01)

(52) U.S. Cl.
CPC ..... *A41D 27/18* (2013.01); *A41D 1/02* (2013.01); *A41D 27/00* (2013.01); *A41D 2400/00* (2013.01)

(58) Field of Classification Search
CPC ..... A41D 1/02; A41D 27/18; A41D 27/04; A41D 2200/20; A41D 3/00; A41B 3/00
See application file for complete search history.

(56) References Cited

U.S. PATENT DOCUMENTS 5,542,124 A * 8/1996 Grilliot ..... A62B 17/003 2/81
5,718,000 A * 2/1998 Ost ..... A41D 13/0012 2/93
7,921,471 B2 * 4/2011 Mordecai ..... A62B 17/006 2/202
8,151,371 B2 * 4/2012 Carpentier ..... A62B 17/003 2/81
2012/0233748 A1 * 9/2012 Curtis ..... A41D 13/00 2/455
2020/0146368 A1 * 5/2020 Skurla, III ..... A41D 27/20
2021/0345700 A1 * 11/2021 Krulik ..... A47K 5/1211
2022/0369744 A1 * 11/2022 York ..... A41F 1/008

* cited by examiner

*Primary Examiner* — Jillian K Pierorazio

(57) ABSTRACT

An article comprising an upper garment with a multi-layer collar configured to extend around a neck region of a subject's body. The multi-layer collar may comprise an inner collar member with a first lower edge and a first upper edge and an outer collar member with a second lower edge and a second upper edge. In some cases, the first lower edge and the second lower edge may be joined together to form a lower edge of the multi-layer collar. In some cases, the first upper edge of the inner collar member may be configured to extend past the second upper edge of the outer collar member.

20 Claims, 7 Drawing Sheets

GARMENT WITH ADJUSTABLE COLLAR

BACKGROUND

Various articles of apparel may be worn by a subject to cover and/or protect the subject's body from external environmental conditions and/or climates. The articles of apparel worn by the subject can directly or indirectly affect or influence the comfort, mental state, and/or physical abilities of a subject wearing the articles of apparel.

SUMMARY

In one aspect, the present disclosure provides various non-limiting examples of articles of apparel with adjustable constructions. The adjustable constructions may allow a subject to adjust the fit of the one or more articles of apparel to (i) improve the subject's mobility or ability to perform various different actions or movements, (ii) enhance the wearing comfort of the articles of apparel, (iii) adjust the aesthetic profile of the articles of apparel, and/or (iv) better protect the subject's body from external conditions and/or climates.

In some embodiments, the articles of apparel may comprise an upper garment with an adjustable collar. In some cases, the adjustable collar may comprise a multi-layer collar configured to extend around a neck region of a subject's body. In some cases, the multi-layer collar may comprise an inner collar member with a first upper edge and a first lower edge. In some cases, the multi-layer collar may comprise an outer collar member with a second upper edge and a second lower edge joined to the first lower edge of the inner collar member. In some cases, the first upper edge of the inner collar member may be configured to extend past the second upper edge of the outer collar member.

In some cases, the adjustable collar may comprise a cord assembly extending through an upper portion of the inner collar member. In some cases, the cord assembly may be configured to secure the first upper edge of the inner collar member around the subject's neck.

In some cases, the article may comprise a ribbon forming one or more cord receiving regions along a back side of the outer collar member. In some cases, the cord assembly may be configured to extend through the one or more cord receiving regions to flexibly hold or movable secure the cord assembly to the outer collar member.

In some cases, the article may comprise a cord cinch mechanism provided along the first upper edge of the inner collar member. In some cases, the cord cinch mechanism may be used to adjust the circumferential length of the cord assembly. In some cases, the cord cinch mechanism may be used to adjust the amount of tension in the cord assembly.

In some cases, the inner collar member comprises (i) a first curved edge extending between a first side of the first upper edge and a first side of the first lower edge and (ii) a second curved edge extending between a second side of the first upper edge and a second side of the first lower edge. In some cases, the first curved edge and the second curved edge are connected to the outer collar member along one or more curved bonding lines. In some cases, the inner collar member and the outer collar member have a same height along the one or more curved bonding lines. In some cases, the inner collar member and the outer collar member have different heights along other portions of the inner and outer collar members.

In some cases, the first curved edge and the second curved edge of the inner collar member are connected to the outer collar member to form a partially enclosed region between the inner collar member and the outer collar member. In some cases, the partially enclosed region comprises one or more curved sides configured to direct water, moisture, condensation, or precipitation towards a bottom corner or edge of the partially enclosed region. In some cases, the one or more curved sides of the partially enclosed region are offset from a left side edge and a right side edge of the outer collar member. In some cases, the left side edge and the right side edge of the outer collar member are configured to extend past the one or more curved sides of the partially enclosed region.

In some cases, the outer collar member comprises a plurality of laser perforated holes in fluid communication with the partially enclosed region. In some cases, the plurality of laser perforated holes are arranged along one or more curved sides of the partially enclosed region. In some cases, the plurality of laser perforated holes are arranged along a bottom left side corner and a bottom right side corner of the partially enclosed region. In some cases, the plurality of laser perforated holes are arranged along a bottom edge of the partially enclosed region.

In some cases, the outer collar member comprises (i) a first set of laser perforated holes distributed across a first portion of the outer collar member and (ii) a second set of laser perforated holes distributed across a second portion of the outer collar member. In some cases, the first portion of the outer collar member includes a greater number of laser perforated holes per unit area than the second portion of the outer collar member.

In some cases, the outer collar member comprises (i) a first set of laser perforated holes centrally located along a bottom edge of the partially enclosed region. In some cases, the outer collar member comprises (ii) a second set of laser perforated holes adjacent to one or more curved sides of the partially enclosed region and (iii) a third set of laser perforated holes provided between the first set of laser perforated holes and the second set of laser perforated holes. In some cases, the third set of laser perforated holes may have fewer holes per unit area than the first and/or second sets of laser perforated holes. In some cases, the outer collar member comprises (ii) a second set of laser perforated holes adjacent to a bottom corner or edge of the partially enclosed region and (iii) a third set of laser perforated holes between the first set of laser perforated holes and the second set of laser perforated holes. In some cases, the third set of laser perforated holes may have fewer holes per unit area than the first and/or second sets of laser perforated holes.

Additional aspects and advantages of the present disclosure will become readily apparent to those skilled in the art from the following detailed description, wherein only illustrative embodiments of the present disclosure are shown and described. As will be realized, the present disclosure is capable of other and different embodiments, and its several details are capable of modifications in various obvious respects, all without departing from the disclosure. Accordingly, the drawings and description are to be regarded as illustrative in nature, and not restrictive.

INCORPORATION BY REFERENCE

All publications, patents, and patent applications mentioned in this specification are herein incorporated by reference to the same extent as if each individual publication, patent, or patent application was specifically and individually indicated to be incorporated by reference. To the extent publications and patents or patent applications incorporated by reference contradict the disclosure contained in the specification, the specification is intended to supersede and/or take precedence over any such contradictory material.

BRIEF DESCRIPTION OF THE DRAWINGS

Non-limiting and non-exhaustive examples of the various embodiments disclosed herein are described with reference to the following figures.

DETAILED DESCRIPTION

Articles of Apparel

In an aspect, the present disclosure provides various articles of apparel that are adjustable to fit and/or conform to a subject's body. In some embodiments, the articles of apparel may comprise a garment.

In some embodiments, the garment may include an upper garment. The upper garment may include, for example, a shirt, a top, a sweater, a jacket, an outer layer, a mid-layer, a base layer, or any other type of garment that can be worn to cover at least an upper portion of a subject's body. In some cases, the upper portion of the subject's body may include, for example, a neck region, a shoulder region, an arm region, a back region, a chest region, a torso region, an abdominal region, a side region, and/or an upper or lower midsection of the subject's body. In some cases, the upper portion of the subject's body may optionally include a waist portion (e.g., an upper waist portion and/or a lower waist portion) of the subject's body.

In some embodiments, the articles of apparel disclosed herein may be worn by a subject engaging or participating in one or more activities. In some embodiments, the one or more activities may comprise a physical activity (e.g., walking, jogging, running, golfing, etc.). In some embodiments, the one or more activities may comprise a non-physical activity (e.g., standing, sitting, resting, lying down, etc.) or any activity that either involves minimal movement or does not involve active movement. In some non-limiting embodiments, the one or more activities may involve one or more golf-related actions or movements performed on or near a golf course or another location proximal to a golf course.

Adjustable Construction

In one aspect, the present disclosure provides an article of apparel with an adjustable construction. In some cases, the adjustable construction may be adjusted to optimize the sizing and/or the overall fit of the article of apparel. In some cases, the adjustable construction may be adjusted to enhance the subject's mobility and/or the subject's ability to perform various actions or movements in different environments. In some cases, the adjustable construction may be adjusted to better protect the subject's body from external conditions or climates. In some cases, the adjustable construction may be adjusted to enhance the wearing comfort and/or the visual appearance of the article of apparel.

Adjustable Collar

In some embodiments, the articles described herein may comprise an upper garment with an adjustable collar. In some cases, the adjustable collar may be configured to extend around a subject's neck region when the subject positions the upper garment around the subject's upper body. In some cases, the adjustable collar may be adjusted to conform to the size and/or shape of the subject's neck.

EXAMPLES

Figure 1A:
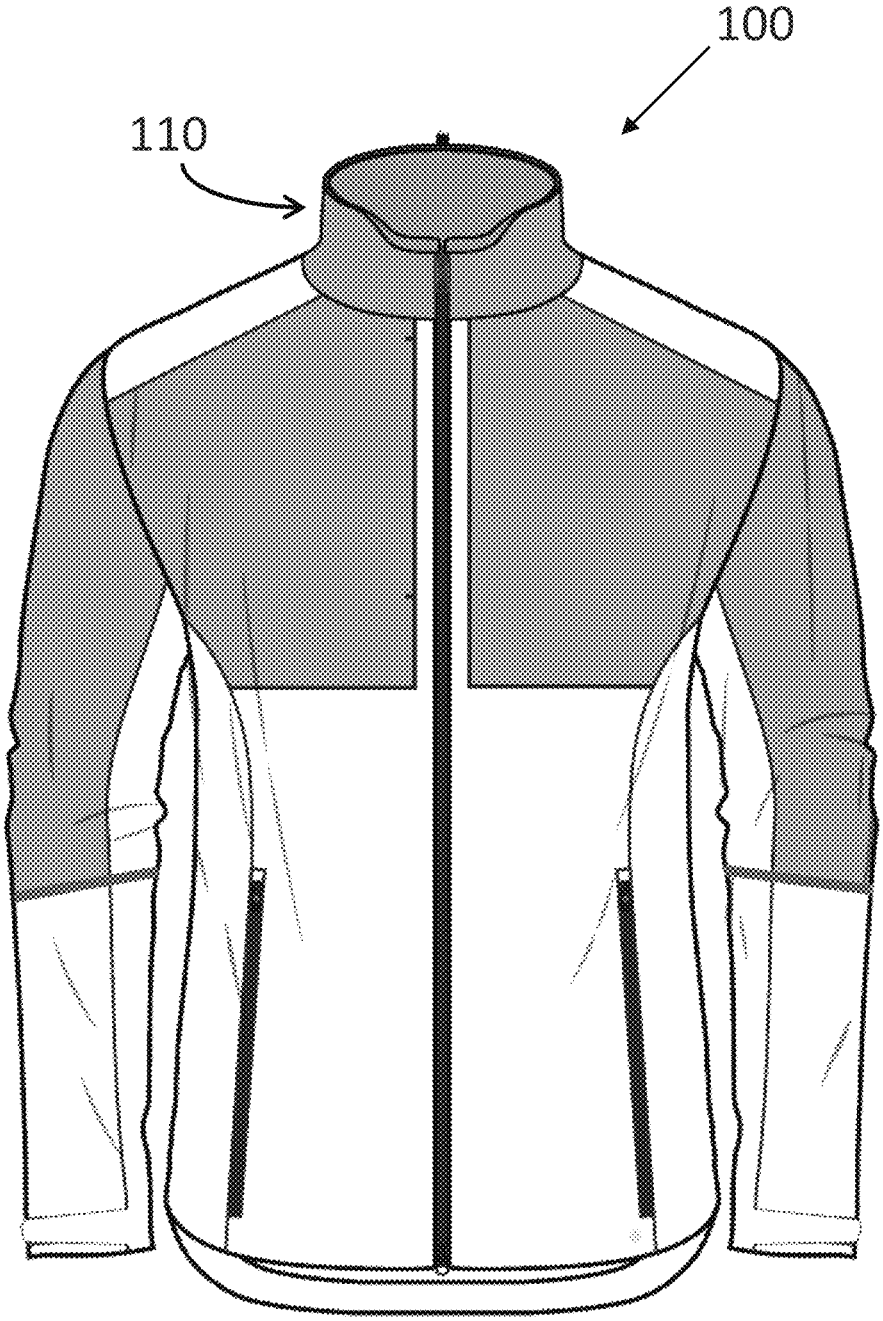
FIGS. 1A and 1B schematically illustrate a front side view and a back side view of an upper garment with an adjustable collar, in accordance with some embodiments.
Figure 1B:
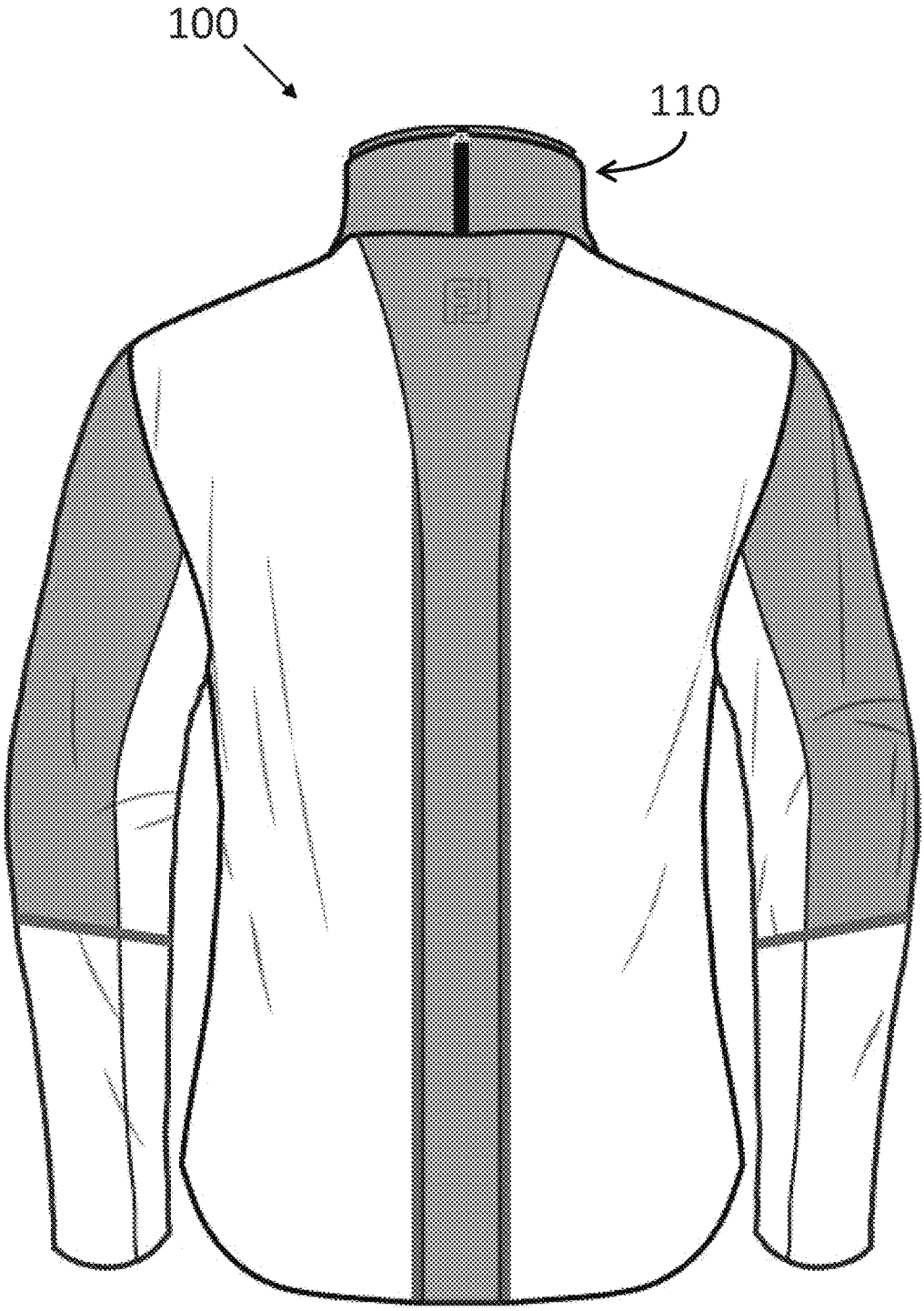

FIGS. 1A and 1B schematically illustrate an example of an article of apparel with an adjustable collar. In some embodiments, the article of apparel may comprise an upper garment 100. In some cases, the upper garment 100 may comprise an adjustable collar 110.

In some cases, the adjustable collar 110 may be a shaped multi-layer collar. In some cases, the shaped multi-layer collar may comprise two or more layers that are partially or fully bonded together to form the shaped multi-layer collar.

Figure 2:
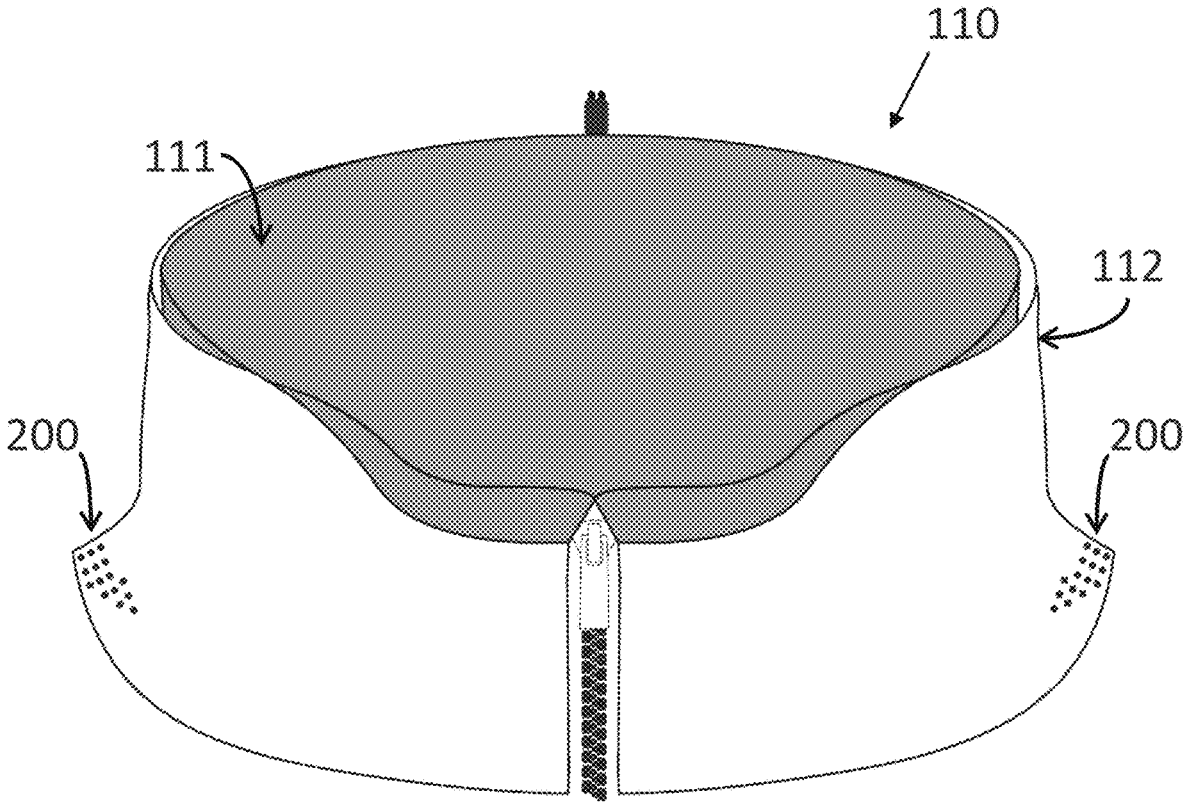
FIGS. 2 and 3 schematically illustrate front and back side views of an adjustable collar for an upper garment, in accordance with some embodiments.
Figure 3:
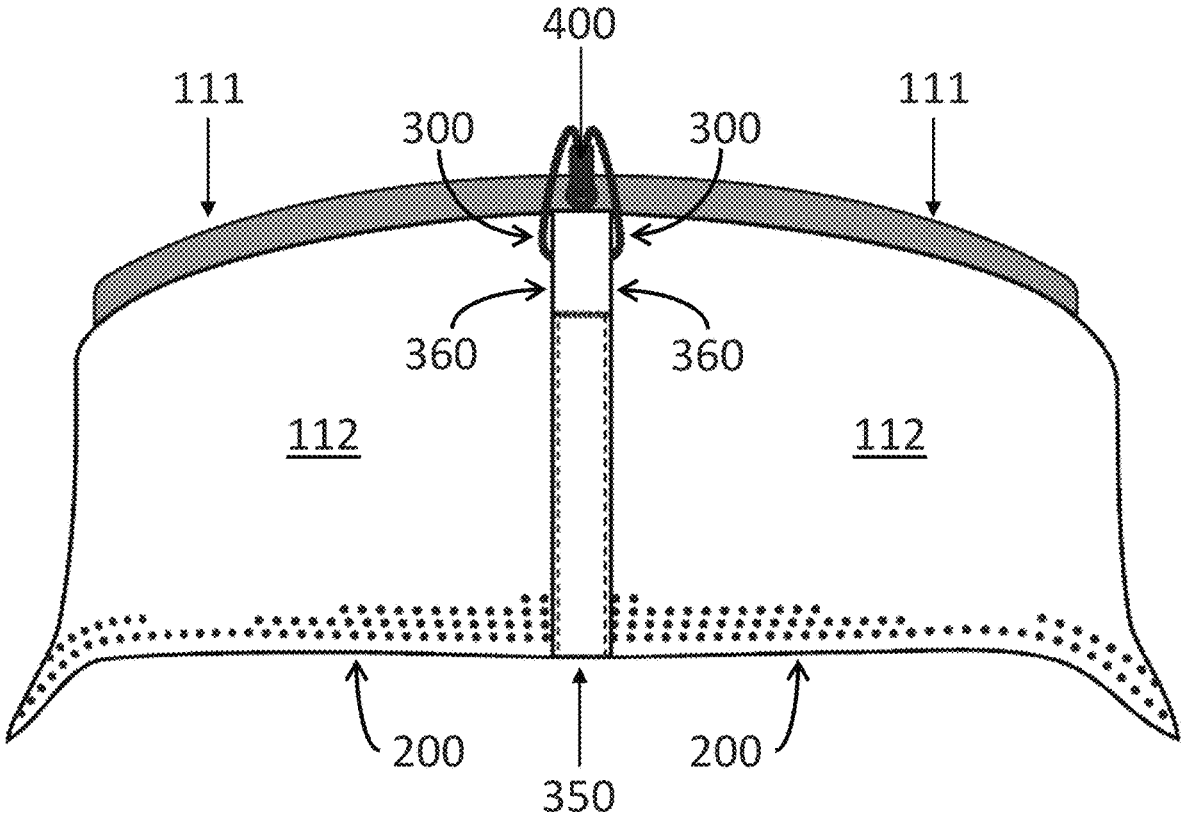

FIGS. 2 and 3 show a front side view and a back side view of an adjustable collar 110 for an upper garment. In some cases, the adjustable collar 110 may comprise a multi-layer collar. In some cases, the multi-layer collar may comprise (i) an inner collar member 111. In some cases, the multi-layer collar may comprise (ii) an outer collar member 112 surrounding or overlapping at least a portion of the inner collar member 111. In some cases, the inner collar member 111 may comprise (i) a lower portion that is overlapped by the outer collar member 112 and (ii) an upper portion that is not overlapped by the outer collar member 112.

In some cases, the inner collar member 111 and the outer collar member 112 may be sized and/or shaped differently. In some cases, the inner collar member may have a different shape or profile than the outer collar member. In some cases, the inner collar member may have a different length, width, and/or height than the outer collar member. In some cases, the inner collar member may be taller than the outer collar member.

In some cases, the inner collar member and/or the outer collar member may comprise a multi-layer construction. In some cases, the multi-layer construction may include two or more layers that are joined together to form the inner and/or outer collar member(s).

In some cases, the inner collar member may comprise a one-piece construction or a multi-piece construction. In some cases, the outer collar member may comprise a one-piece construction or a multi-piece construction.

Collar Construction

Figure 4:
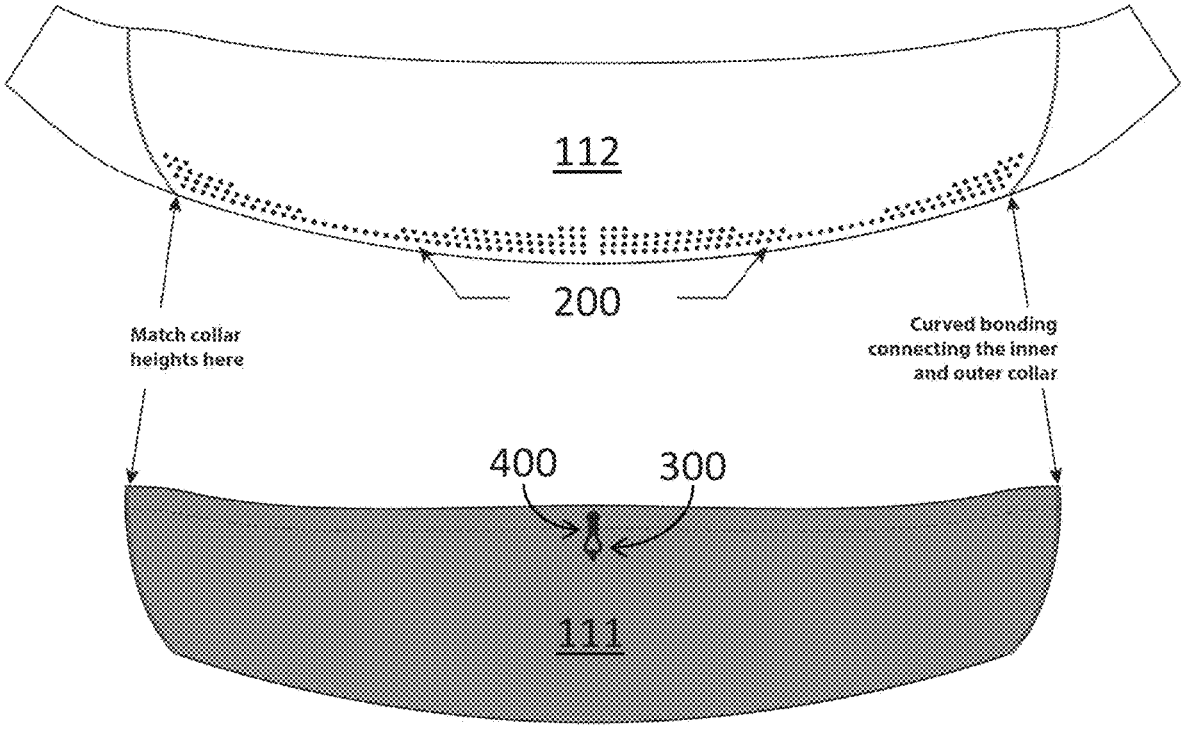
FIG. 4 schematically illustrates an adjustable collar with an outer collar member and an inner collar member, in accordance with some embodiments.

FIGS. 2-4 schematically illustrate a multi-layer collar for an upper garment. In some cases, the multi-layer collar may comprise an inner collar member 111 and an outer collar member 112. In some cases, the inner collar member 111 may have a first lower edge and a first upper edge. In some cases, the outer collar member 112 may have a second lower edge and a second upper edge.

In some cases, the first lower edge and the second lower edge may be joined together to form a lower edge of the multi-layer collar. In some cases, the first upper edge and the second upper edge may not or need not be joined together so that the inner collar member 111 and the outer collar member 112 can be moved, repositioned, manipulated, and/or adjusted independently of one another.

In some cases, the first upper edge of the inner collar member 111 may extend past the second upper edge of the outer collar member 112. In some cases, the first upper edge of the inner collar member may be positioned above the second upper edge of the outer collar member.

In some cases, the inner collar member 111 may have a first end and a second end opposite the first end. In some cases, the outer collar member 112 may have a first end and a second end opposite the first end. In some cases, the first end of the outer collar member 112 may be configured to extend past the first end of the inner collar member 111. In some cases, the second end of the outer collar member 112 may be configured to extend past the second end of the inner collar member 111.

In some cases, the inner collar member may comprise (i) a first curved edge extending between a first side of the first upper edge and a first side of the first lower edge. In some cases, the inner collar member may comprise (ii) a second curved edge extending between a second side of the first upper edge and a second side of the first lower edge.

In some cases, the first curved edge and the second curved edge of the inner collar member may be connected to the outer collar member to form a partially enclosed region between the inner collar member and the outer collar member. In some cases, the first curved edge of the inner collar member may be attached to the outer collar member along a first attachment interface. In some cases, the second curved edge of the inner collar member may be attached to the outer collar member along a second attachment interface.

In some cases, the inner collar member may have a bottom left side corner disposed between a left side edge of the inner collar member and the lower edge of the inner collar member. In some cases, the inner collar member may have a bottom right side corner disposed between the a right side edge of the inner collar member and the lower edge of the inner collar member. In some cases, the bottom left and/or right side corners of the inner collar member may be rounded.

Partially Enclosed Region

In some cases, the inner collar member 111 may be connected to the outer collar member 112 to form a partially enclosed region between the inner collar member and the outer collar member. In some cases, the partially enclosed region may be configured to extend circumferentially around a subject's neck.

In some cases, the partially enclosed region may be bounded by (i) a first attachment interface connecting the first curved edge of the inner collar to the outer collar. In some cases, the partially enclosed region may be bounded by (ii) a second attachment interface connecting the second curved edge of the inner collar to the outer collar. In some cases, the partially enclosed region may be bounded by (iii) a third attachment interface connecting the first lower edge of the inner collar and the second lower edge of the outer collar.

In some cases, the upper edges of the inner collar and the upper edges of the outer collar may form the upper edges of the partially enclosed region. In some cases, the upper edges of the partially enclosed region may not or need not be bounded so that the upper edges of the inner and outer collars can be moved or adjusted independently of each other. In some cases, the upper edges of the partially enclosed region may not or need not be bounded so that the subject can access the partially enclosed region between the inner and outer collars.

In some cases, the curved edges of the inner collar may be joined to the outer collar along one or more curved bonding lines. In some cases, the curved bonding lines may define or outline the sides of the partially enclosed region. In some cases, the height of the inner collar may be the same as the height of the outer collar along the parts of the inner and outer collars that are directly joined along the curved bonding lines. In some cases, the heights of the remaining portions of the inner and outer collars may differ.

In some cases, the partially enclosed region may have one or more curved sides. In some cases, the curved sides may be formed by the curved bonding lines joining the left and/or right side edges of the inner collar to the outer collar.

In some cases, the curved sides of the partially enclosed region may be aligned with a left side edge and/or a right side edge of the inner collar member. In some cases, the left and/or right side edges of the inner collar member may be configured to extend along the curved sides of the partially enclosed region.

In some cases, the curved sides of the partially enclosed region may be offset from a left side edge and/or a right side edge of the outer collar member. In some cases, the left and/or right side edges of the outer collar member may be configured to extend past the curved sides of the partially enclosed region.

In some cases, the partially enclosed region may have a bottom left side corner and a bottom right side corner. In some cases, the bottom left side corner and/or the bottom right side corner of the partially enclosed region may be rounded.

In some cases, the partially enclosed region may be configured to collect water, moisture, condensation, and/or precipitation in one or more predetermined locations within the partially enclosed region. In some cases, the curved sides of the partially enclosed region may be configured as gutters that can channel water, moisture, condensation, and/or precipitation towards the one or more predetermined locations. In some cases, the one or more predetermined locations may be in fluid communication with one or more drainage holes formed in the outer collar member.

Drainage Holes

In some cases, the outer collar member may comprise one or more drainage holes 200 in fluid communication with the partially enclosed region. In some cases, the drainage holes may be configured to drain water, moisture, condensation, and/or precipitation caught between the inner collar and the outer collar. In some cases, the one or more drainage holes may be configured to prevent water, moisture, condensation, and/or precipitation from building up or collecting within the partially enclosed region provided between the inner and outer collar members.

In some cases, the drainage holes may include a plurality of laser perforated holes. In some cases, the plurality of laser perforated holes may be arranged along or across different portions or sections of the outer collar member. In some cases, the plurality of laser perforated holes may be provided through select portions of the outer collar member.

In some cases, the plurality of laser perforated holes may be arranged along or adjacent to a lower edge of the outer collar member. In some cases, the plurality of laser perforated holes may be arranged along or adjacent to the parts of the outer collar member that are joined to the lower edge of the inner collar member. In some cases, the plurality of laser perforated holes may be arranged along or adjacent to the bottom edge of the partially enclosed region.

In some cases, the plurality of laser perforated holes may be arranged along or adjacent to the parts of the outer collar member that are joined to the curved edges of the inner collar member. In some cases, the plurality of laser perforated holes may be arranged along or adjacent to the curved sides of the partially enclosed region formed between the inner and outer collar members.

In some cases, the plurality of laser perforated holes may be arranged along or adjacent to the parts of the outer collar member that overlap a bottom left and/or right side corner of the inner collar member. In some cases, the bottom left and/or right side corner of the inner collar member may correspond to an area of the inner collar member that is bounded by the lower edge of the inner collar member and the curved sides or edges of the inner collar member. In some cases, the plurality of laser perforated holes may be arranged along or adjacent to the bottom left and/or right side corners of the partially enclosed region formed between the inner and outer collar members.

Perforation Density

In some cases, the outer collar member may comprise a plurality of laser perforated holes distributed across the outer collar member. In some cases, the laser perforated holes may be more densely clustered around the parts of the partially enclosed region which receive or collect more water, moisture, condensation, and/or precipitation. In some cases, the laser perforated holes may be less densely clustered around the other parts of the partially enclosed region which receive or collect less water, moisture, condensation, and/or precipitation.

In some cases, the outer collar member may comprise (i) a first set of laser perforated holes distributed across a first portion of the outer collar member. In some cases, the outer collar member may further comprise (ii) a second set of laser perforated holes distributed across a second portion of the outer collar member. In some cases, the first portion of the outer collar member may include a greater number of laser perforated holes per unit area than the second portion of the outer collar member. In some cases, the second portion of the outer collar member may include a greater number of laser perforated holes per unit area than the first portion of the outer collar member.

In some cases, the outer collar member may comprise a first set of laser perforated holes centrally located along a bottom edge of the outer collar member. In some cases, the outer collar member may comprise a second set of laser perforated holes adjacent to (i) the first attachment interface connecting the first curved edge of the inner collar to the outer collar and/or (ii) the second attachment interface connecting the second curved edge of the inner collar to the outer collar. In some cases, the outer collar member may comprise a third set of laser perforated holes provided between the first and second sets of laser perforated holes. In some cases, the third set of laser perforated holes may have fewer holes per unit area than the first and/or second sets of laser perforated holes.

In some cases, the outer collar member may comprise a first set of laser perforated holes centrally located along a bottom edge of the outer collar member. In some cases, the outer collar member may optionally or alternatively comprise a second set of laser perforated holes adjacent to a first curved edge and/or a second curved edge of the inner collar or the partially enclosed region provided between the inner and outer collar. In some cases, the outer collar member may comprise a third set of laser perforated holes between the first and second sets of laser perforated holes. In some cases, the third set of laser perforated holes may have fewer holes per unit area than the first and/or second sets of laser perforated holes.

In some cases, the outer collar member may comprise a first set of laser perforated holes centrally located along a bottom edge of the outer collar member. In some cases, the outer collar member may optionally or alternatively comprise a second set of laser perforated holes adjacent to a first end and/or a second end of the inner collar or the partially enclosed region provided between the inner and outer collar. In some cases, the outer collar member may comprise a third set of laser perforated holes between the first and second sets of laser perforated holes. In some cases, the third set of laser perforated holes may have fewer holes per unit area than the first and/or second sets of laser perforated holes.

In some cases, the outer collar member may comprise a first set of laser perforated holes centrally located along a bottom edge of the outer collar member. In some cases, the outer collar member may optionally or alternatively comprise a second set of laser perforated holes adjacent to a bottom left side corner and/or a bottom right side corner of the inner collar or the partially enclosed region provided between the inner and outer collar. In some cases, the outer collar member may comprise a third set of laser perforated holes between the first and second sets of laser perforated holes. In some cases, the third set of laser perforated holes may have fewer holes per unit area than the first and/or second sets of laser perforated holes.

Cord Assembly

In some cases, the adjustable collar may comprise a cord assembly. In some cases, the cord assembly may be manipulated to adjust the positioning of the inner collar member around a subject's neck. In some cases, the cord assembly may be manipulated to adjust the tightness of the inner collar member around the subject's neck.

In some cases, the cord assembly may be configured to extend through the inner collar member. In some cases, the cord assembly may be configured to extend through an upper portion of the inner collar member. In some cases, the upper portion of the inner collar member may include a part of the inner collar that is not covered or overlapped by the outer collar member. In some cases, the upper portion of the inner collar member may include a part of the inner collar that is positioned entirely above an upper edge of the outer collar member.

In some cases, the cord assembly may comprise a cord with a first end attached to a first side of the inner collar and a second end attached to a second side of the inner collar. In some cases, the first end of the cord may be attached to a first interior portion of the inner collar and the second end of the cord may be attached to a second interior portion of the inner collar. In some cases, the first interior portion of the inner collar may be disposed along the first side of the inner collar and the second interior portion of the inner collar may be disposed along the second side of the inner collar.

In some cases, the cord may have a cord length extending between the first and second ends of the cord. In some cases, the cord length may be configured to form a cord loop around the subject's neck when the inner collar is positioned around the subject's neck.

In some cases, the cord may have a first cord segment configured to extend through the inner collar from the first end of the cord towards an opening disposed on an upper portion of a back side of the inner collar. In some cases, the first segment may extend out of the inner collar through the opening so that a subject wearing the upper garment can access the first cord segment. In some cases, the cord may have a second cord segment extending between the first cord segment and the second end of the cord. In some cases, the second cord segment may be configured to extend through the opening back into the inner collar and towards the second end of the cord. In some cases, the first cord segment and the second cord segment may form a secondary loop 300 that is external to the inner collar.

In some cases, a ribbon or a strip of material 350 may be provided along a front or back side of the outer collar. In some cases, the ribbon or strip of material may be attached or coupled to the front or back side of the outer collar to form one or more cord receiving regions 360 between the ribbon or the strip of material and the front or back side of the outer collar.

In some cases, the one or more cord receiving regions 360 may be configured to receive one or more cord segments of the cord assembly. In some cases, the one or more cord receiving regions may be configured to receive a looped end portion of the secondary loop 300. In some cases, the looped end portion of the secondary loop 300 may be configured to extend through the one or more cord receiving regions. In some cases, the one or more cord receiving regions may be configured to flexibly hold or movably secure the secondary loop 300 to the outer collar when the looped end portion of the secondary loop 300 is threaded through the one or more cord receiving regions.

Cord Adjustment Mechanism

As shown in FIGS. 3 and 4, in some cases, the cord assembly may comprise a cord adjustment mechanism 400. In some cases, the cord adjustment mechanism may be manipulated to adjust the circumferential length of the cord loop around the subject's neck. In some cases, the cord adjustment mechanism may be manipulated to adjust the amount of tension in the cord loop.

In some cases, the cord adjustment mechanism 400 may be connected to the cord segments forming the secondary loop 300. In some cases, the cord adjustment mechanism may be disposed between (i) the opening on the back side of the inner collar and (ii) the looped end portion of the secondary loop 300. In some cases, the cord adjustment mechanism may be provided (i) along an upper portion of the inner collar and/or (ii) above the upper edge of the outer collar so that a subject can easily access and/or manipulate the cord adjustment mechanism.

In some cases, the cord adjustment mechanism 400 may comprise a cord cinch mechanism. In some cases, the cord cinch mechanism may be configured to receive the cord segments forming the secondary loop 300. In some cases, the cord cinch may be configured to hold select portions of the cord segments to set (i) the circumferential length of the cord loop extending around the subject's neck and/or (ii) the amount of tension in the cord loop extending around the subject's neck.

In some cases, the cord cinch mechanism may be repositioned to hold different portions of the cord segments. In some cases, the cord cinch mechanism may be repositioned by holding the cord cinch mechanism and pulling the cord segments in one or more directions. In other cases, the cord cinch mechanism may be repositioned by holding the cord segments and pulling the cord cinch mechanism in one or more directions.

In some cases, when the cord cinch mechanism is positioned along a first portion of the cord segments, the cord loop extending around the subject's neck may have a first tensioned or untensioned circumferential length. In some cases, when the cord cinch mechanism is positioned along a second portion of the cord segments, the cord loop extending around the subject's neck may have a second tensioned or untensioned circumferential length that is different than the first tensioned or untensioned circumferential length.

In some cases, when the cord cinch mechanism is positioned along a first portion of the cord segments, the cord loop extending around the subject's neck may be under a first amount of tension. In some cases, when the cord cinch mechanism is positioned along a second portion of the cord segments, the cord loop extending around the subject's neck may be under a second amount of tension that is different than the first amount of tension.

In some cases, the cord cinch mechanisms described herein may be repositioned to adjust the circumferential length of the cord loop extending around the subject's neck. In some cases, the cord cinch mechanisms of the present disclosure may be repositioned to adjust the amount of tension in the cord loop extending around the subject's neck.

Zipper Guard

Figure 5:
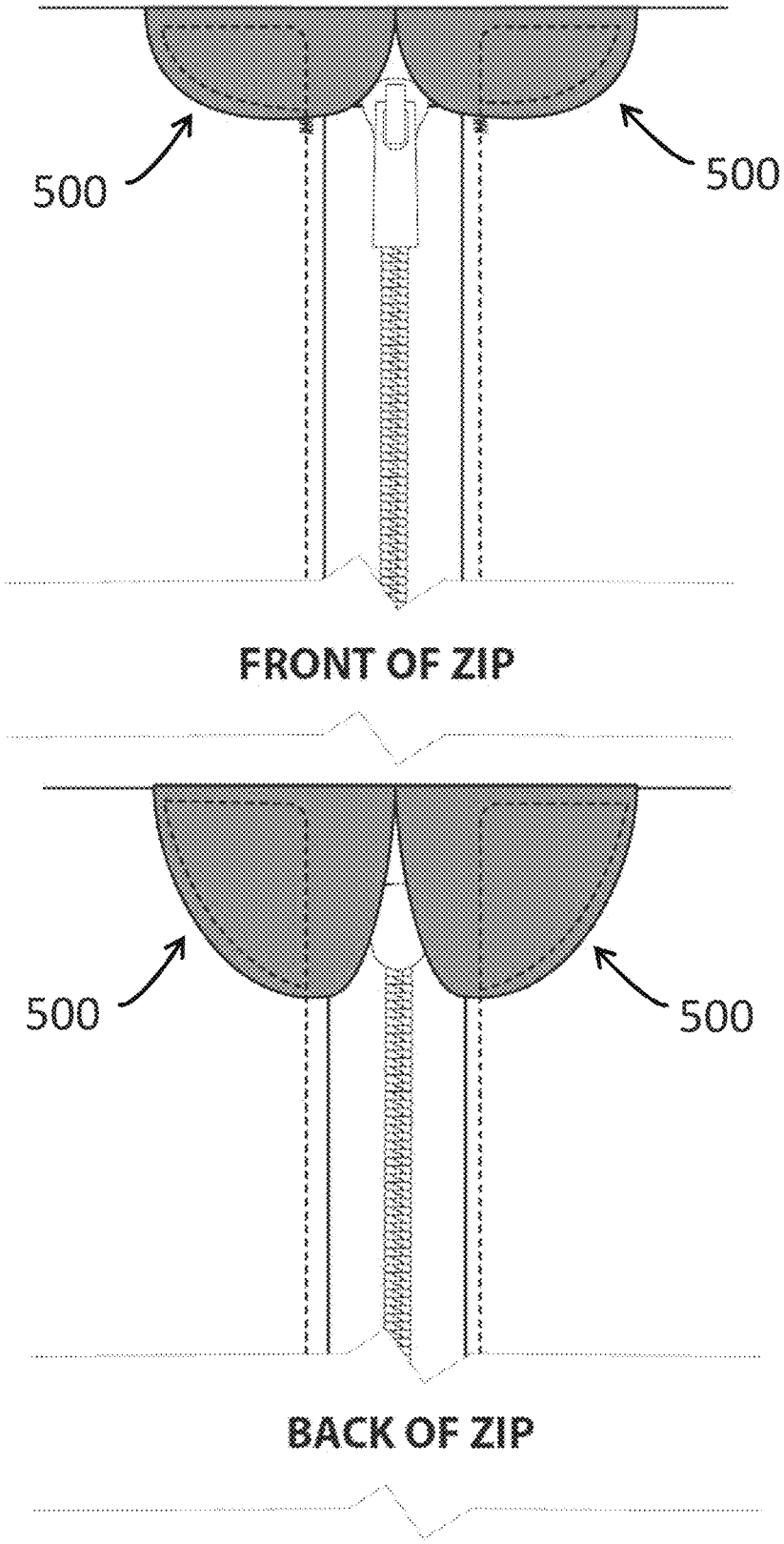
FIG. 5 schematically illustrates a front side view and a back side view of a zipper guard for an upper garment, in accordance with some embodiments.

Referring now to FIG. 5, in some cases, the collar assembly may include one or more zipper guards 500. In some cases, the one or more zipper guards 500 may include a set of kissing zipper guards. In some cases, the kissing zipper guards may include zipper guards that are mirrored on each side of a zipper setting of the upper garment.

In some cases, the kissing zipper guards may be configured to extend towards each other to form a zipper garage configured to receive a zipper of the upper garment. In some cases, the sides or edges of the kissing zipper guards may be configured to converge towards the center of the upper garment. In some cases, the sides or edges of the kissing zipper guards may contact and/or overlap each other. In other cases, the sides or edges of the kissing zipper guards may not or need not contact or overlap. In some cases, the sides or edges of the kissing zipper guards may be spaced apart and/or separated from one another.

In some cases, the zipper guards may have a multi-layer construction. In some cases, the multi-layer construction may include two or more layers that are stitched together and turned inside out to form the one or more zipper guards.

Figure 6:
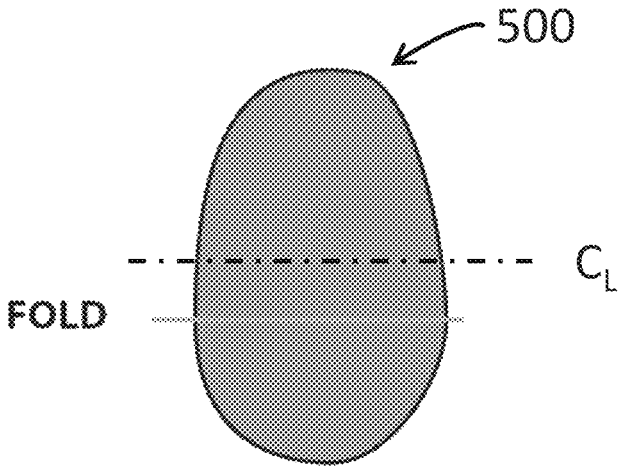
FIG. 6 schematically illustrates a piece of material that can be folded over the collar to form a zipper guard for the upper garment, in accordance with some embodiments.

FIG. 6 schematically illustrates a piece of material that can be folded over the collar to form the one or more zipper guards 500. In some cases, the zipper guards may be folded along an axis that is offset from a vertical or horizontal center line $C_L$ of the zipper guards. In some cases, when the zipper guards are folded along an axis that is offset from the vertical or horizontal center line $C_L$, the front sides (i.e., the outside facing surfaces) of the zipper guards may have a different size or shape than the back sides (i.e., the inside facing surfaces) of the zipper guards.

In some cases, the zipper guards may be stitched to the corners of the upper left and right edges of the collar. In some cases, the zipper guards may be single needle stitched to the sides and/or edges of the collar.

Storm Flap

In some cases, the upper garment may comprise a storm flap extending along the zipper setting of the upper garment. In some cases, the storm flap may be secured to the panels of the garment along one or more stitch lines. In some cases, the stitch lines may align or coincide with the single needle stitches joining the zipper guards to the sides and/or edges of the collar.

Outer Shell

In some cases, the upper garment may comprise an outer shell layer that is directly exposed to an external environment. In some cases, the outer shell layer may overlie one or more other panels or layers of the upper garment.

In some cases, the outer shell layer may comprise a durable material. In some cases, the durable material may comprise a water repellant or water resistant material. In some cases, the durable material may comprise a weather-resistant material.

In some cases, the outer shell layer may be water repellant. In some embodiments, one or more hydrophobic coatings may be applied to provide a durable water repellent (DWR) layer which repels any precipitation contacting the external surface of the outer shell layer. In some embodiments, the outer shell layer may be a water-resistant fabric that is substantially impervious to water.

In some cases, the outer shell layer may be weather resistant. In some cases, the weather resistant outer shell layer may be generally resistant to water and/or wind. In some cases, the weather-resistant outer shell layer may be substantially impervious to one or more fluids in a liquid phase, a gaseous phase, or a vapor phase. In some cases, the weather-resistant outer shell layer may be substantially impervious to wind and/or air currents. In some cases, the weather-resistant outer shell layer may also be substantially impervious to water and/or other precipitation.

In some cases, the outer shell layer may be impermeable or semi-permeable to solids, liquids, vapors, and/or gases. In some cases, the outer shell layer may be selectively permeable or semi-permeable in different directions through the outer shell layer. In some cases, the outer shell layer may be selectively permeable in a first direction from an inner side of the outer shell layer (i.e., a side of the outer shell layer facing inwards towards the subject's body) to an outer side of the outer shell layer (i.e., a side of the outer shell layer that is directly exposed to an external environment) in order to (1) enhance the breathability of the garment and (2) expel or remove any unwanted moisture inside or within the garment (e.g., due to condensation of water vapor and/or perspiration). In some cases, the outer shell layer may be impermeable or semi-permeable in a second direction from the outer side of the outer shell layer to the inner side of the outer shell layer in order to prevent a movement of precipitation (e.g., drizzle, rain, sleet, snow, ice pellets, and/or hail) into an interior region of the articles disclosed herein.

Additional Notes

While various embodiments of the invention are shown and described herein, it will be obvious to those skilled in the art that such embodiments are provided by way of example only. Numerous variations, changes, and substitutions may occur to those skilled in the art without departing from the invention. It should be understood that various alternatives to the embodiments of the invention described herein may be employed.

One of skill in the art will appreciate that these articles are provided for illustrative purposes, and that other articles may be employed to perform the functionalities disclosed herein without departing from the scope of the disclosure. Moreover, while different examples and embodiments may be described separately, such embodiments and examples may be combined with one another to implement the technology described herein. One skilled in the art will recognize other embodiments or improvements that are within the scope and spirit of the present technology. Therefore, the specific structure, acts, or media are disclosed only as illustrative embodiments. The scope of the present disclosure is further represented below in the following claims.

What is claimed is:

1. An article, comprising:

an upper garment with a multi-layer collar configured to extend around a neck region of a subject's body, wherein the multi-layer collar comprises:

(i) an inner collar member with a first upper edge and a first lower edge;

(ii) an outer collar member with a second upper edge and a second lower edge joined to the first lower edge of the inner collar member, and wherein the first upper edge of the inner collar member is configured to extend past the second upper edge of the outer collar member; and (iii) a cord assembly extending through an upper portion of the inner collar member, wherein the cord assembly is configured to secure the first upper edge of the inner collar member around the subject's neck.

2. The article of claim 1, wherein the inner collar member comprises (i) a first curved edge extending between a first side of the first upper edge and a first side of the first lower edge and (ii) a second curved edge extending between a second side of the first upper edge and a second side of the first lower edge.

3. The article of claim 2, wherein the first curved edge and the second curved edge are connected to the outer collar member along one or more curved bonding lines.

4. The article of claim 3, wherein the inner collar member and the outer collar member have a same height along the one or more curved bonding lines.

5. The article of claim 4, wherein the inner collar member and the outer collar member have different heights along other portions of the inner and outer collar members.

6. The article of claim 2, wherein the first curved edge and the second curved edge of the inner collar member are connected to the outer collar member to form a partially enclosed region between the inner collar member and the outer collar member.

7. The article of claim 6, wherein the partially enclosed region comprises one or more curved sides configured to direct water, moisture, condensation, or precipitation towards a bottom corner or edge of the partially enclosed region.

8. The article of claim 7, wherein the one or more curved sides of the partially enclosed region are offset from a left side edge and a right side edge of the outer collar member.

9. The article of claim 8, wherein the left side edge and the right side edge of the outer collar member are configured to extend past the one or more curved sides of the partially enclosed region.

10. The article of claim 6, wherein the outer collar member comprises a plurality of laser perforated holes in fluid communication with the partially enclosed region.

11. The article of claim 10, wherein the plurality of laser perforated holes are arranged along one or more curved sides of the partially enclosed region.

12. The article of claim 10, wherein the plurality of laser perforated holes are arranged along a bottom left side corner and a bottom right side corner of the partially enclosed region.

13. The article of claim 10, wherein the plurality of laser perforated holes are arranged along a bottom edge of the partially enclosed region.

14. The article of claim 10, wherein the outer collar member comprises (i) a first set of laser perforated holes distributed across a first portion of the outer collar member and (ii) a second set of laser perforated holes distributed across a second portion of the outer collar member, wherein the first portion of the outer collar member includes a greater number of laser perforated holes per unit area than the second portion of the outer collar member.

15. The article of claim 10, wherein the outer collar member comprises (i) a first set of laser perforated holes centrally located along a bottom edge of the partially enclosed region.

16. The article of claim 15, wherein the outer collar member further comprises (ii) a second set of laser perforated holes adjacent to one or more curved sides of the partially enclosed region and (iii) a third set of laser perforated holes provided between the first set of laser perforated holes and the second set of laser perforated holes, the third set of laser perforated holes having fewer holes per unit area than the first and/or second sets of laser perforated holes.

17. The article of claim 15, wherein the outer collar member comprises (ii) a second set of laser perforated holes adjacent to a bottom corner or edge of the partially enclosed region and (iii) a third set of laser perforated holes between the first set of laser perforated holes and the second set of laser perforated holes, the third set of laser perforated holes having fewer holes per unit area than the first and/or second sets of laser perforated holes.

18. The article of claim 1, further comprising a ribbon forming one or more cord receiving regions along a back side of the outer collar member.

19. The article of claim 18, wherein the cord assembly is configured to extend through the one or more cord receiving regions to flexibly hold or movable secure the cord assembly to the outer collar member.

20. The article of claim 19, further comprising a cord cinch mechanism provided along the first upper edge of the inner collar member.

* * * * *